US006312026B1

(12) United States Patent
Workman

(10) Patent No.: US 6,312,026 B1
(45) Date of Patent: Nov. 6, 2001

(54) DOOR KNOB ASSEMBLY

(76) Inventor: Tom E. Workman, 4200 Armstrong Pkwy., Dallas, TX (US) 75205

( * ) Notice: Subject to any disclaimer, the term of this patent is extended or adjusted under 35 U.S.C. 154(b) by 0 days.

(21) Appl. No.: 09/543,478

(22) Filed: Apr. 6, 2000

(51) Int. Cl.[7] ..... E05C 19/00
(52) U.S. Cl. ..... 292/252; 292/347
(58) Field of Search ..... 292/1, 163, 175, 292/347, 348, 350, 336.3, 252; 74/543; 16/412; 49/460, 501

(56) References Cited

U.S. PATENT DOCUMENTS

| | | | | |
|---|---|---|---|---|
| 62,599 | * | 3/1867 | Bristol | 292/350 |
| 1,744,458 | * | 1/1930 | Ellingson | 292/350 |
| 2,002,542 | * | 5/1935 | McKinney, Jr. | 292/352 X |
| 2,070,149 | * | 2/1937 | Turner | 292/252 |
| 2,832,623 | * | 4/1958 | Golemon | 292/252 |
| 3,508,777 | * | 4/1970 | McBurnie | 292/350 X |
| 3,933,014 | | 1/1976 | Moses . | |
| 4,437,695 | | 3/1984 | Foshee . | |
| 4,575,137 | | 3/1986 | Jans . | |
| 4,639,021 | | 1/1987 | Hope . | |
| 4,639,026 | | 1/1987 | Smallegan . | |
| 4,650,229 | * | 3/1987 | Bardfeld | 292/348 X |
| 5,011,204 | | 4/1991 | Labrum . | |
| 5,316,355 | | 5/1994 | Hartwell et al. . | |
| 5,688,005 | | 11/1997 | Ellis . | |

* cited by examiner

*Primary Examiner*—Teri Pham Luu
(74) *Attorney, Agent, or Firm*—Daniel V. Thompson

(57) ABSTRACT

A door knob assembly (10) attachable to a door (24), the door knob assembly (10) having an inner door knob (12I) having an inner door knob threaded opening (12IA) positioned on an inner door (24I). The door knob assembly (10) further comprises a door latch (20) positioned within a door side (24S). The door latch (20) further has a door latch engager (20B) which has a door latch engager cylinder (20BA) containing a door latch engager member biasing means (20BCA) positioned against a door latch engager member (20BC). The door latch engager member (20BC) frictionally engages a door plate (24A). An upper fastener (22U) is positioned through the door latch engager plate upper opening (20BBU) and the door latch upper housing lip opening (20AUAA) and securely attached to the door side (24S).

6 Claims, 6 Drawing Sheets

DOOR KNOB ASSEMBLY

TECHNICAL FIELD

The present invention relates to door latching devices. More particularly, the present invention relates to door locks having concealed fastening means.

BACKGROUND ART

Numerous innovations for door knob assemblies have been provided in the prior art that are described as follows. Even though these innovations may be suitable for the specific individual purposes to which they address, they differ from the present invention as hereinafter contrasted.

In U.S. Pat. No. 4,639,026, titled Door Knob and Door Knob Catch Arrangement, invented by Jon M. Smallegan, a standard, door knob-operated, latch mechanism is described in which the cylindrical shank of the door knob is slidably engaged with the rotatable spindle of the mechanism, and the spindle has a spring-biased catch projecting therethrough which passes into a slot formed in the cylindrical shank of the knob. In this way, the knob is secured on the shank. The improvement comprises forming a ramp in a cut-out on the terminal or outermost end of the cylindrical shank, and forming a complimentary bevel on a corner of the projecting catch. Accordingly, when the knob is slidably forced onto its spindle, during manufacturing assembly, the ramp formed in the cut-out engages the bevel and, consequently, depresses the catch to allow the cylindrical shank to slide thereupon and thereover, and to allow the catch latchingly to engage the slot.

In U.S. Pat. No. 4,639,021, titled Door Lock, invented by Jimmie L. Hope, a door lock is described for use particularly with sliding patio doors. The lock assembly includes a rotary actuator (door knob) connected to a shaft which drives a crank connected, in turn, to one or more spring-biased bolt rods and operable through the crank to shift the bolt rod to its spring-biased, door-locking position. Stops are positioned to stop the movement of the crank in the locking and unlocking positions of the bolt rod, respectively. Rotary interengaging means such as a pair of meshing gears releasably connect the crank to the shaft assembly. A latch maintains the spring-biased bolt rod releasably in its door-locking position when the gears are meshed. A trip disengages the gear when the bolt rod is in its spring-biased, door-locking position, thereby actuating automatic unlocking of the door.

In U.S. Pat. No. 4,575,137, titled Latch Mechanism and Locking Adaptor, invented by Franz W. Jans, a door latch mechanism is described which includes a housing having a bolt extending outwardly therefrom, and a split sleeve extending through the housing and disposed to drive adjacent cams concentric with the sleeve to operate a retractor to retract the bolt against a biasing spring. The split sleeve receives a split spindle of a door knob assembly to rotate the sleeve and retract the bolt. A locking adapter includes a generally cylindrical housing having a chordal slot for receiving the latch housing therethrough. The cylindrical housing includes aligned apertures through which the spindle extends. A locking cam is secured in one aperture, and a lock release cam is secured in the other aperture. A lock shaft extends through the housing parallel to the axis of the apertures, and includes a boss for engaging and blocking the locking cam to lock the spindle, and a protrusion engagable by the release cam to drive the lock shaft axially to release engagement of the boss and the locking cam. The adapter is joinable to the latch housing to permit locking of the latch mechanism from either side thereof, and the lock is released by rotation of the knob on the locking side.

In U.S. Pat. No. 3,933,014, titled Door Lock Attachment, invented by Adolph Moses, a device is described which is a cheap, one piece, pocketable, one hand operated, snap on or off clamping attachment for a lock bolt thumb knob for preventing the lock from being opened from the outside. One end of the attachment has connected elements that can embrace the thumb knob in either its vertical or horizontal position. The connected elements have two extended legs that spring grip the door knob hub and can bias the attachment to its operative position or hold it in its inoperative position. This cheap device takes the place of a more expensive bolt and its installation cost.

The above patented inventions differ from the present invention because they fail to describe or claim at least one combination of the following features depicted in the present invention.

SUMMARY OF THE INVENTION

The present invention is door lock assembly, mounted on a door, which has at least one door knob. The door knob when pushed or pulled actuates a ball shank which functions to retract a spring loaded ball nose permitting a door to open. A receptacle is attached to a door jamb functioning to receive the spring loaded ball nose when the door is closed preventing the door from being opened without actuating the door knob. The present invention further has a concealed attachment means functioning to provide a cosmetically pleasing appearance.

The types of problems encountered in the prior art are opening a secured door without requiring a twisting motion being applied to a door knob. The significant need addressed is the ability of a person to open a door when the person's hands are otherwise engaged.

In the prior art, unsuccessful attempts to solve this problem were attempted, namely: locking mechanisms which require a twisting motion to actuate a locking mechanism. However, the problem was solved by the present invention because the door knobs are pushed to retract a spring loaded ball nose from a doorjamb receptacle.

The present invention went contrary to the teaching of the art which used a twisting motion to retract a ball nose.

The present invention solved a long felt need for a secure door closure means which can be actuated by a pushing motion.

The present invention produced unexpected results namely ease of access for persons in wheel chairs, and with crutches.

Accordingly, it is an object of the present invention to provide an inner door knob and an outer door knob.

More particularly, it is an object of the present invention to provide a spring loaded ball nose.

In keeping with these objects, and with others which will become apparent hereinafter, one feature of the present invention resides, briefly stated, in a door latch which is retracted when the inner door knob or the outer door knob are pushed or pulled.

When the door knob assembly is designed in accordance with the present invention, a door may be opened hands free.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

List of Reference Numerals Utilized in The Drawings

10-door knob assembly (10)
12I-inner door knob (12I)
121A-inner door knob threaded opening (12IA)
12O-outer door knob (12O)
12OA-outer door knob threaded opening (12OA)
14I-inner connector (14I)
14IA-inner connector first end (14IA)
14IB-inner connector second end (14IB)
14IL-inner connector left peg (14IL)
14IR-inner connector right peg (14IR)
14O-outer connector (14O)
14OA-outer connector first end (14OA)
14OB-outer connector second end (14OB)
14OL-outer connector left peg (14OL)
14OR-outer connector right peg (14OR)
16-housing (16)
16L-left housing (16L)
16LA-left housing groove (16LA)
16LAO-left housing groove outer hole (16LAO)
16LAI-left housing groove inner hole (16LAI)
16LB-left housing threaded opening (16LB)
16R-right housing (16R)
16RA-right housing groove (16RA)
16RAO-right housing groove outer hole (16RAO)
16RAI-right housing groove inner hole (16RAI)
16RB-right housing opening (16RB)
18-first fastener (18)
18A-first fastener threaded end (18A)
18B-first fastener tightening cap (18B)
18C-first fastener shaft (18C)
20-door latch (20)
20A-door latch housing (20A)
20AL-door latch lower housing (20AL)
20ALA-door latch lower housing lip (20ALA)
20ALAA-door latch lower housing lip opening (20ALAA)
20AU-door latch upper housing (20AU)
20AUA-door latch upper housing lip (20AUA)
20AUAA-door latch upper housing lip opening (20AUAA)
20AC-door latch center housing (20AC)
20ACA-door latch center housing opening (20ACA)
20B-door latch engager (20B)
20BA-door latch engager cylinder (20BA)
20BB-door latch engager plate (20BB)
20BBU-door latch engager plate upper opening (20BBU)
20BBL-door latch engager plate lower opening (20BBL)
20BC-door latch engager member (20BC)
20BCA-door latch engager member biasing means (20BCA)
20BCB-door latch engager member spacer (20BCB)
22U-upper fastener (22U)
22L-lower fastener (22L)
24-door (24)
24A-door plate (24A)
24I-inner door (24I)
24O-outer door (24O)
24S-door side (24S)

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
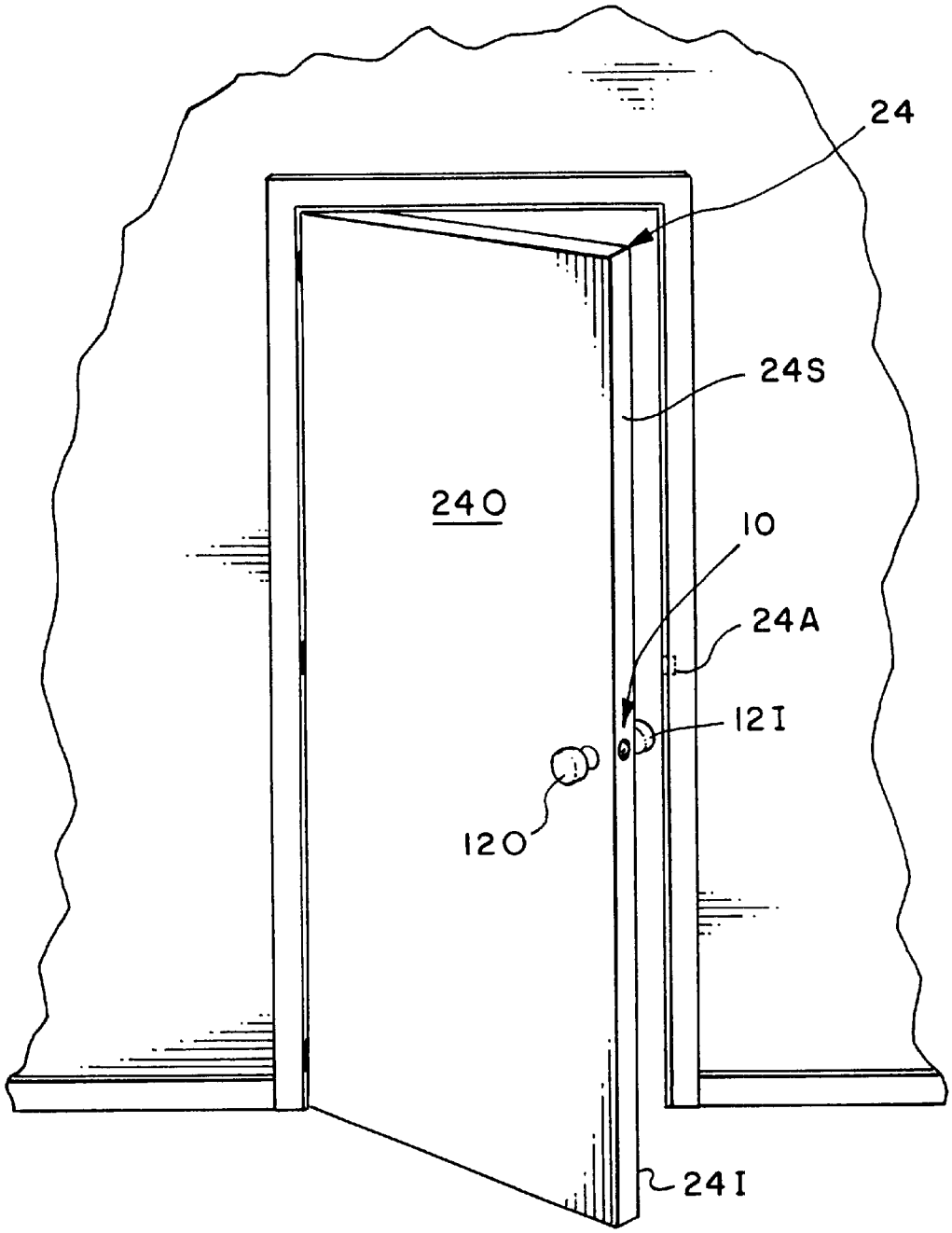
FIG. 1 is a perspective view of a door knob assembly installed on a door.

Firstly, referring to FIG. 1 which is a perspective view of a door knob assembly (10) installed on a door (24). The door knob assembly (10) comprises an inner door knob (12I) and an outer door knob (12O) which function when pushed or pulled, respectively, by a user to release the door knob assembly (10) from the door plate (24A) permitting the door to swing open. When the door knob assembly (10) is pushed/pulled by a user and the door is closed the door knob assembly (10) is releasably attached to the door plate (24A). A key of feature of the invention is that the inner door knob (12I) and outer door knob (12O) exhibit no visible fastening means.

Figure 2:
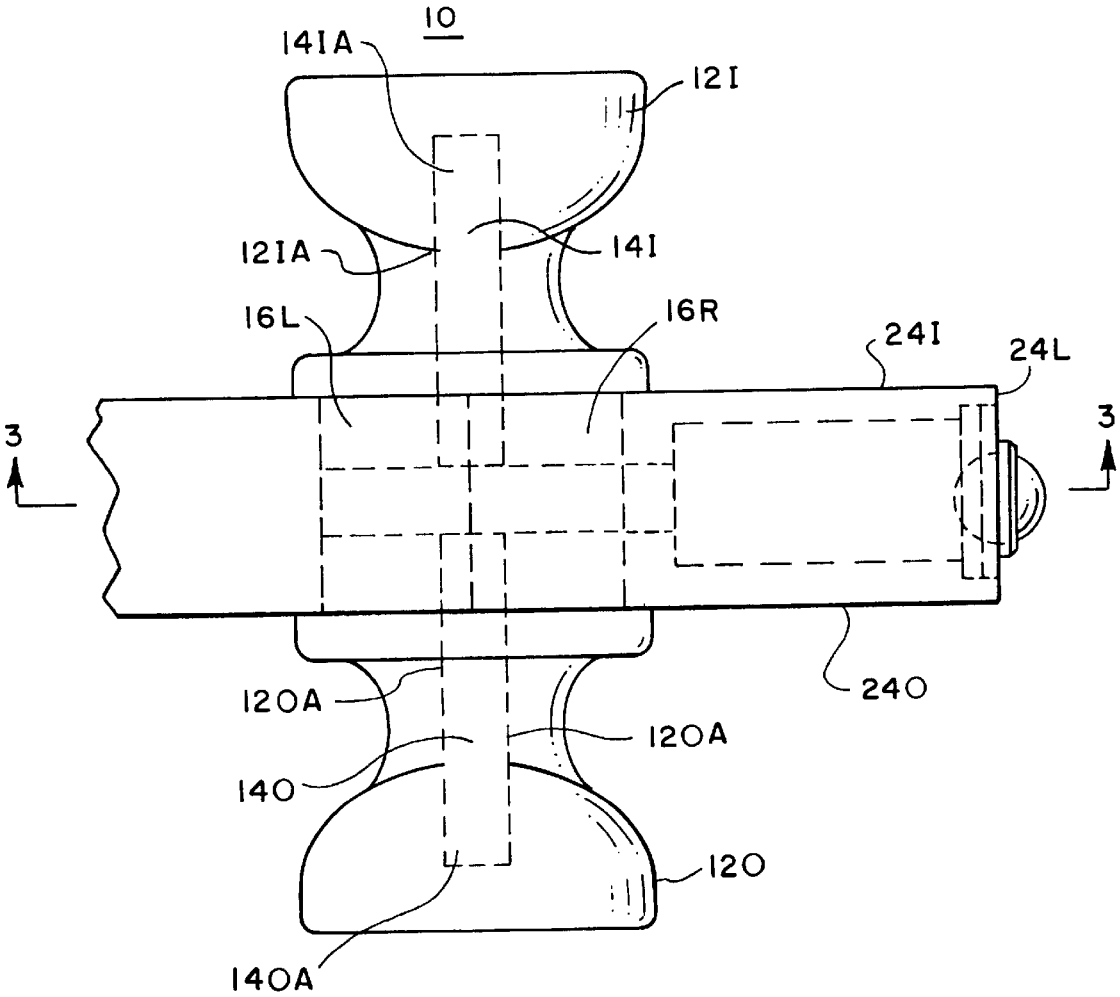
FIG. 2 is a top view of a door knob assembly.

Secondly, referring to FIG. 2 which is a top view of the door knob assembly (10). The door knob assembly (10) is attached to the door (24). The door knob assembly (10) comprises an inner door knob (12I) having an inner door knob threaded opening (12IA) positioned on an inner door (24I). The door knob assembly (10) further comprises an outer door knob (12O) having an outer door knob threaded opening (12OA) positioned on an outer door (24O). An inner connector (14I) having an inner connector first end (14IA) is engagably mounted within the inner door knob threaded opening (12IA). The engagement of the inner connector first end (14IA) and the inner door knob threaded opening (12IA) functions to provide a concealed attachment of the inner door knob (12I). The door knob assembly (10) further comprises an outer connector (14O) having an outer connector first end (14OA) engagably mounted within the outer door knob threaded opening (12OA). The engagement of the outer connector first end (14OA) and the outer door knob threaded opening (12OA) functions to provide a concealed attachment of the outer door knob (12O).

The door knob assembly (10) further comprises a housing (16) which comprises a left housing (16L) having a left housing groove (16LA) with a left housing threaded opening (16LB) therein. The left housing groove (16LA) comprises a left housing groove outer hole (16LAO) which engages the outer connector left peg (14OL) and a left housing groove inner hole (16LAI) which engages the outer connector left peg (14OL).

The housing (16) further comprises a right housing (16R) having a right housing groove (16RA) with a right housing threaded opening (16RB) therethrough. The inner connector second end (14IB) and the outer connector second end (14OB) are positioned within the left housing groove (16LA) and the right housing groove (16RA) and securely fastened to the housing (16). The right housing groove (16RA) comprises a right housing groove outer hole (16LAO) which engages the outer connector right peg (14OL) and a right housing groove inner hole (16LAI) which engages the outer connector right peg (14OR).

The door knob assembly (10) further comprises a door latch (20) positioned within a door side (24S). The door latch (20) comprises a door latch housing (20A) having an opening positioned in a bottom end thereof. The door latch housing (20A) comprises a door latch lower housing (20AL) connected to a door latch upper housing (20AU) by a door latch center housing (20AC) having a door latch center housing opening (20ACA) therethrough.

The door latch (20) further comprises a door latch lower housing lip (20ALA) having a door latch lower housing lip opening (20ALAA) therethrough and a door latch upper housing lip (20AUA) having a door latch upper housing lip opening (20AUAA) therethrough. The door latch (20) further comprises a door latch engager (20B) which comprises a door latch engager cylinder (20BA) containing a door latch engager member biasing means (20BCA) positioned against a door latch engager member (20BC), a top distal opening of the door latch engager cylinder (20BA) is slightly smaller in diameter than a diameter of the door latch engager member (20BC). The door latch engager member (20BC) further comprises a door latch engager member spacer (20BCB) positioned within the door latch engager cylinder (20BA) adjacent to an opposite distal end of the door latch engager member biasing means (20BCA) to the door latch engager member (20BC).

The door latch engager (20B) further comprises a door latch engager plate (20BB) having a door latch engager plate upper opening (20BBU) and a door latch engager plate lower opening (20BBL). The door latch engager member (20BC) frictionally engages a door plate (24A). An upper fastener (22U) is positioned through the door latch engager plate upper opening (20BBU) and the door latch upper housing lip opening (20AUAA) and securely attached to the door side (24S). A lower fastener (22L) is positioned through the door latch engager plate lower opening (20BBL) and the door latch lower housing lip opening (20ALAA) and securely attached to the door side (24S).

The door knob assembly (10) further comprises a first fastener (18) having a first fastener threaded end (18A), a first fastener tightening cap (18B), and a first fastener shaft (18C). The first fastener (18) is positioned through the door latch housing (20A) opening and through right housing opening (16RB). The first fastener threaded end (18A) engages the left housing threaded opening (16LB).

Figure 3:
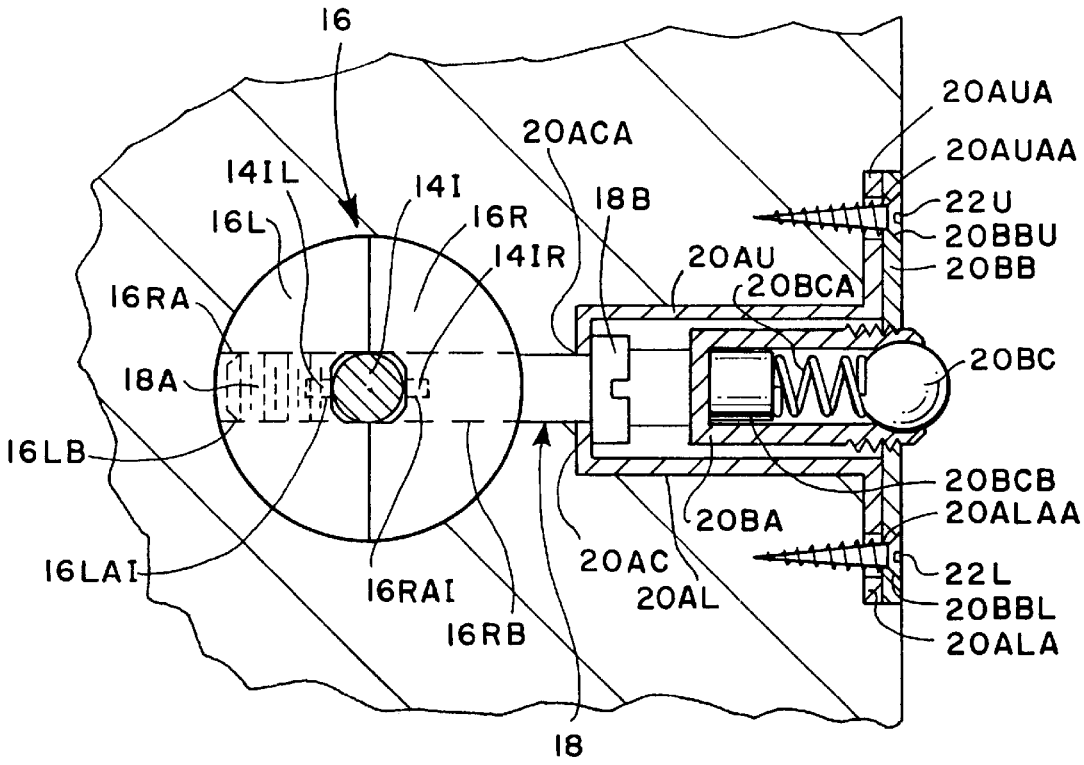
FIG. 3 is a right side view of a door knob assembly.

Thirdly, referring to FIG. 3 which is a right side view of a door knob assembly (10) which comprises an inner connector (14I) having an inner connector first end (14IA) engagably mounted within the inner door knob threaded opening (12IA). The inner connector (14I) further comprises an inner connector second end (14IB). The inner connector (14I) further comprises an inner connector left peg (14IL) and an inner connector right peg (14IR) extending outwardly therefrom. The outer connector (14O) further comprises an outer connector left peg (14OL) and an outer connector right peg (14OR) extending outwardly therefrom.

The door knob assembly (10) further comprises a housing (16) which comprises a left housing (16L) having a left housing threaded opening (16LB) therein. A left housing groove inner hole (16LAI) engages an inner connector left peg (14IL)

The housing (16) further comprises a right housing (16R) having a right housing groove (16RA) with a right housing threaded opening (16RB) therethrough. The right housing groove (16RA) is securely fastened to the housing (16). The right housing groove (16RA) comprises a right housing groove outer hole (16LAO) which engages the outer connector right peg (14OL) and a right housing groove inner hole (1 6LAI) which engages the outer connector right peg (14OR).

The door knob assembly (10) further comprises a door latch (20). The door latch (20) comprises a door latch housing (20A) having an opening positioned in a bottom end thereof The door latch housing (20A) comprises a door latch lower housing (20AL) connected to a door latch upper housing (20AU) by a door latch center housing (20AC) having a door latch center housing opening (20ACA) therethrough.

The door latch (20) further comprises a door latch lower housing lip (20ALA) having a door latch lower housing lip opening (20ALAA) therethrough and a door latch upper housing lip (20AUA) having a door latch upper housing lip opening (20AUAA) therethrough. The door latch (20) further comprises a door latch engager (20B) which comprises a door latch engager cylinder (20BA) containing a door latch engager member biasing means (20BCA) positioned against a door latch engager member (20BC), a top distal opening of the door latch engager cylinder (20BA) is slightly smaller in diameter than a diameter of the door latch engager member (20BC). The door latch engager member (20BC) further comprises a door latch engager member spacer (20BCB) positioned within the door latch engager cylinder (20BA) adjacent to an opposite distal end of the door latch engager member biasing means (20BCA) to the door latch engager member (20BC).

The door latch engager (20B) further comprises a door latch engager plate (20BB) having a door latch engager plate upper opening (20BBU) and a door latch engager plate lower opening (20BBL). The door latch engager member (20BC) frictionally engages a door plate (24A). An upper fastener (22U) is positioned through the door latch engager plate upper opening (20BBU) and the door latch upper housing lip opening (20AUAA) and securely attached to the door side (24S). A lower fastener (22L) is positioned through the door latch engager plate lower opening (20BBL) and the door latch lower housing lip opening (20ALAA) and securely attached to the door side (24S).

The door knob assembly (10) further comprises a first fastener (18) having a first fastener threaded end (18A), a first fastener tightening cap (18B), and a first fastener shaft (18C). The first fastener (18) is positioned through the door latch housing (20A) opening and through right housing opening (16RB). The first fastener threaded end (18A) engages the left housing threaded opening (16LB).

Figure 4:
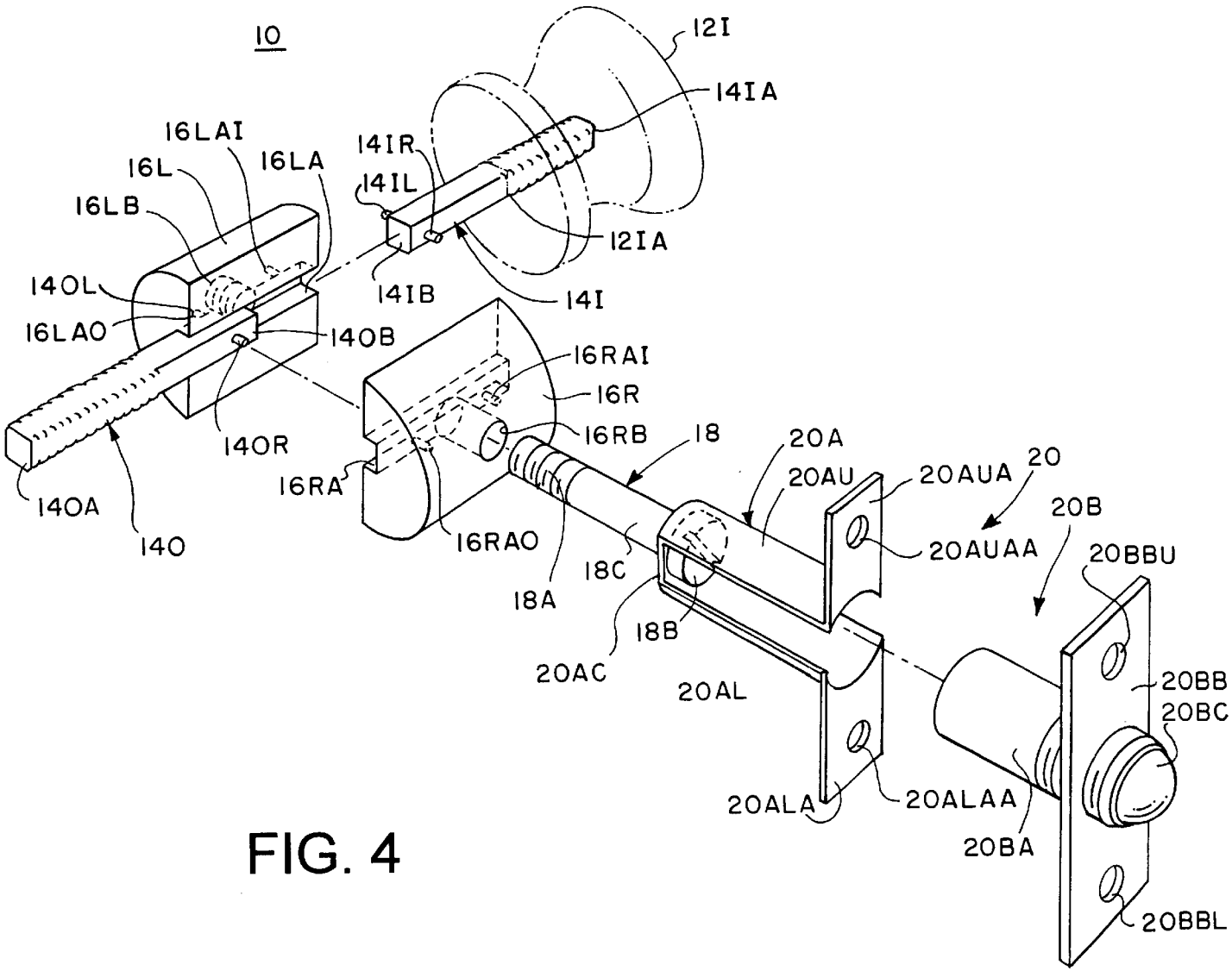
FIG. 4 is an exploded view of a door knob assembly.

Lastly, referring to FIG. 4 which is an exploded view of a door knob assembly (10) which comprises an inner door knob (12I), having an inner door knob threaded opening (12IA), positioned on an inner door (24I).

The door knob assembly (10) further comprises an outer door knob (12O) having an outer door knob threaded opening (12OA) positioned on outer door (24O).

The door knob assembly (10) further comprises an inner connector (14I) having an inner connector first end (14IA) engagably mounted within the inner door knob threaded opening (12IA). The inner connector (14I) further comprises an inner connector second end (14IB). The inner connector (14I) further comprises an inner connector left peg (14IL) and an inner connector right peg (14IR) extending outwardly therefrom. The outer connector (14O) further comprises an outer connector left peg (14OL) and an outer connector right peg (14OR) extending outwardly therefrom.

The door knob assembly (10) further comprises an outer connector (14O) having an outer connector first end (14OA) engagably mounted within the outer door knob threaded opening (12OA). The outer connector (14O) further comprises an outer connector second end (14OB).

The door knob assembly (10) further comprises a housing (16) which comprises a left housing (16L) having a left housing groove (16LA) with a left housing threaded opening (16LB) therein. The left housing groove (16LA) comprises a left housing groove outer hole (16LAO) which engages the outer connector left peg (14OL) and a left housing groove inner hole (16LAI) which engages the outer connector left peg (14OL).

The housing (16) further comprises a right housing (16R) having a right housing groove (16RA) with a right housing threaded opening (16RB) therethrough. The inner connector second end (14IB) and the outer connector second end (14OB) are positioned within the left housing groove (16LA) and the right housing groove (16RA) and securely fastened to the housing (16). The right housing groove (16RA) comprises a right housing groove outer hole (16LAO) which engages the outer connector right peg (14OL) and a right housing groove inner hole (16LAI) which engages the outer connector right peg (14OR).

The door knob assembly (10) further comprises a door latch (20) positioned within a door side (24S). The door latch (20) comprises a door latch housing (20A) having an opening positioned in a bottom end thereof. The door latch housing (20A) comprises a door latch lower housing (20AL) connected to a door latch upper housing (20AU) by a door latch center housing (20AC) having a door latch center housing opening (20ACA) therethrough.

The door latch (20) further comprises a door latch lower housing lip (20ALA) having a door latch lower housing lip opening (20ALAA) therethrough and a door latch upper housing lip (20AUA) having a door latch upper housing lip opening (20AUAA) therethrough. The door latch (20) further comprises a door latch engager (20B) which comprises a door latch engager cylinder (20BA) containing a door latch engager member biasing means (20BCA) positioned against a door latch engager member (20BC), a top distal opening of the door latch engager cylinder (20BA) is slightly smaller in diameter than a diameter of the door latch engager member (20BC). The door latch engager member (20BC) further comprises a door latch engager member spacer (20BCB) positioned within the door latch engager cylinder (20BA) adjacent to an opposite distal end of the door latch engager member biasing means (20BCA) to the door latch engager member (20BC).

The door latch engager (20B) further comprises a door latch engager plate (20BB) having a door latch engager plate upper opening (20BBU) and a door latch engager plate lower opening (20BBL). The door latch engager member (20BC) frictionally engages a door plate (24A), an upper fastener (22U) is positioned through the door latch engager plate upper opening (20BBU) and the door latch upper housing lip opening (20AUAA) and securely attached to the door side (24S), a lower fastener (22L) is positioned through the door latch engager plate lower opening (20BBL) and the door latch lower housing lip opening (20ALAA) and securely attached to the door side (24S).

The door knob assembly (10) further comprises a first fastener (18) having a first fastener threaded end (18A), a first fastener tightening cap (18B), and a first fastener shaft (18C). The first fastener (18) is positioned through the door latch housing (20A) opening and through right housing opening (16RB). The first fastener threaded end (18A) engages the left housing threaded opening (16LB).

Figure 5:
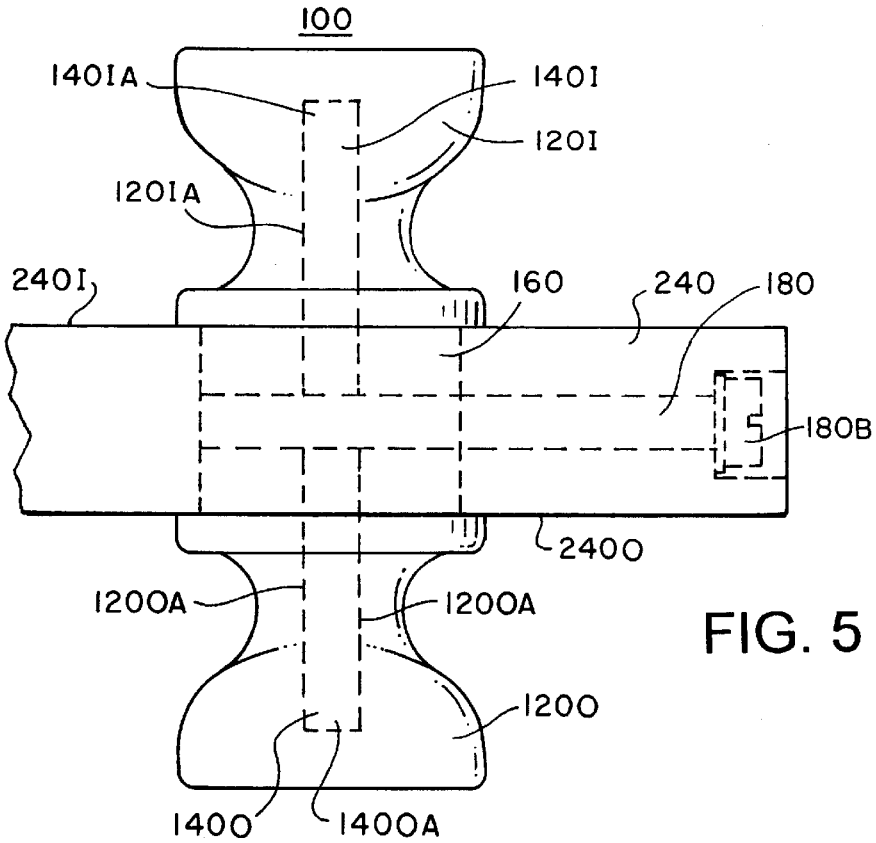
FIG. 5 is a top view of an alternate embodiment of a door knob assembly.
Figure 6:
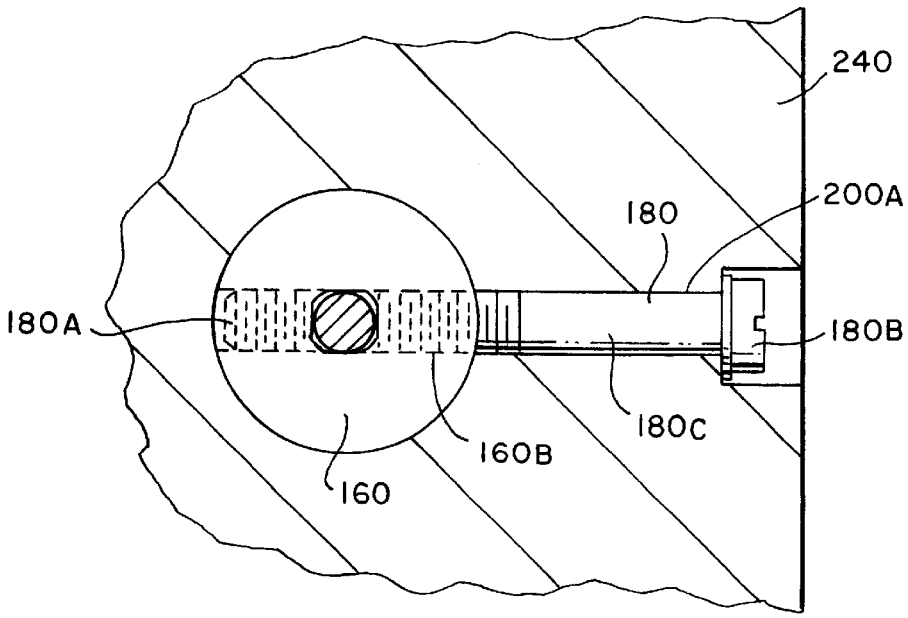
FIG. 6 is a right side view of the door knob assembly of FIG. 5.
Figure 7:
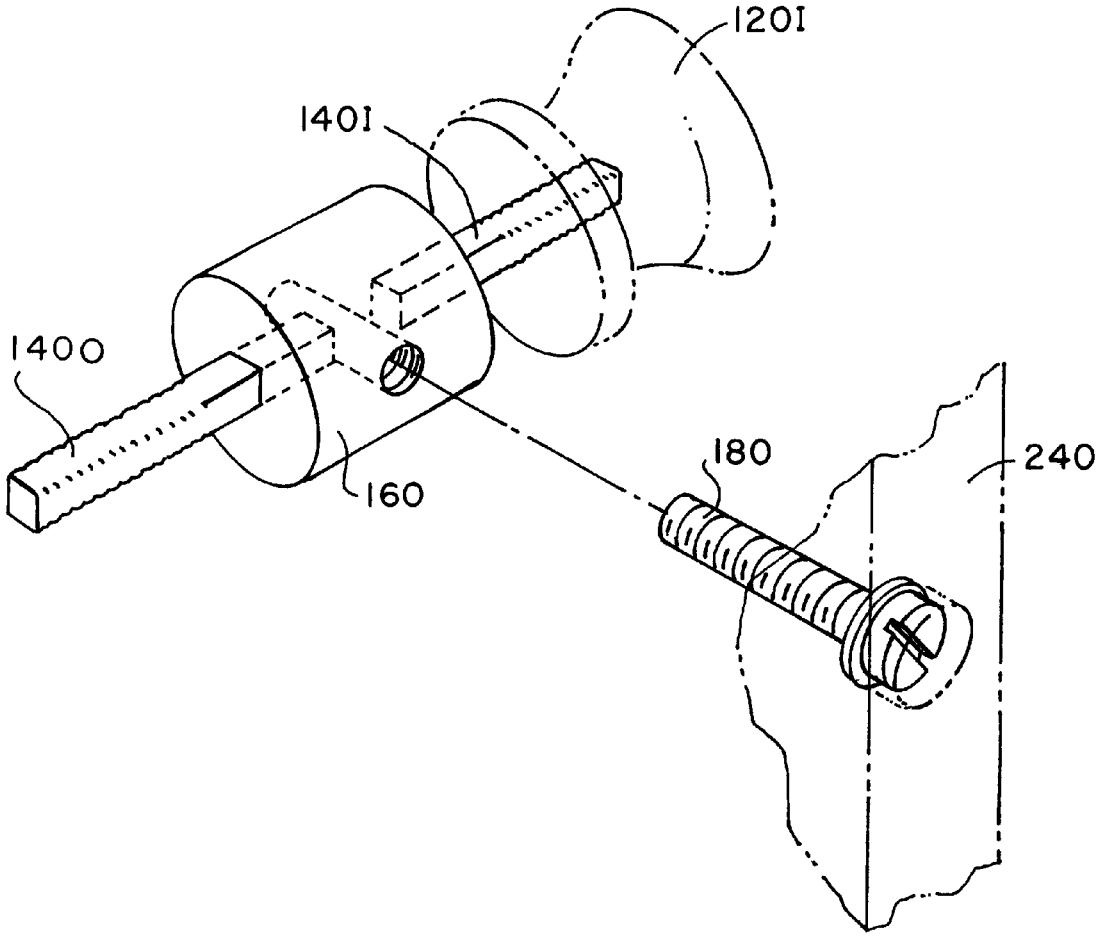
FIG. 7 is an exploded view of the door knob assembly of FIG. 5.

FIGS. 5, 6 and 7 show alternate door knob assembly (100). The door knob assembly (100) is attached to the door (240). The door knob assembly (100) comprises an inner door knob (120I) having an inner door knob threaded opening (120IA) positioned on an inner door (240I). The door knob assembly (100) further comprises an outer door knob (120O) having an outer door knob threaded opening (120OA) positioned on an outer door (240O). An inner connector (140I) having an inner connector first end (140IA) is engagably mounted within the inner door knob threaded opening (120IA). The engagement of the inner connector first end (140IA) and the inner door knob threaded opening (120IA) functions to provide a concealed attachment of the inner door knob (120I). The door knob assembly (100) further comprises an outer connector (140O) having an outer connector first end (140OA) engagably mounted within the outer door knob threaded opening (120OA). The engagement of the outer connector first end (140OA) and the outer door knob threaded opening (120OA) functions to provide a concealed attachment of the outer door knob (120O).

The door knob assembly (10) further comprises a one piece housing (160). A first fastener (180) has a first fastener threaded end (180A), a first fastener tightening cap (180B), and a first fastener shaft (180C). The first fastener (180) is positioned through the door opening (200A) and through housing opening (160B). The first fastener threaded end (180A) engages the housing threaded opening (160B).

It will be understood that each of the elements described above, or two or more together, may also find a useful application in other types of constructions differing from the type described above.

While the invention has been illustrated and described as embodied in a door knob assembly, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by letters patent is set forth in the appended claims Whereas, the present invention has been described with respect to a specific embodiment thereof, it will be understood that various changes and modifications will be suggested to one skilled in the art and it is intended to encompass such changes and modifications as fall within the scope of the appended claims.

I claim:

1. A door knob assembly (10) attachable to a door (24), the door knob assembly (10) comprising:

A) an inner door knob (12I) having an inner door knob threaded opening (12IA) positioned on an inner door (24I);

B) an outer door knob (12O) having an outer door knob threaded opening (12OA) positioned on outer door (24O);

C) an inner connector (14I) having an inner connector first end (14IA) engagably mounted within the inner door knob threaded opening (12IA), the inner connector (14I) further comprises an inner connector second end (14IB);

D) an outer connector (14O) having an outer connector first end (14OA) engagably mounted within the outer door knob threaded opening (12OA), the outer connector (14O) further comprises an outer connector second end (14OB);

E) a housing (16) which comprises a left housing (16L) having a left housing groove (16LA) with a left housing threaded opening (16LB) therein, the housing (16) further comprises a right housing (16R) having a right housing groove (16RA) with a right housing threaded opening (16RB) therethrough, the inner connector second end (14IB) and the outer connector second end (14OB) are positioned within the left housing groove (16LA) and the right housing groove (16RA) and securely fastened to the housing (16);

F) a door latch (20) positioned within a door side (24S), the door latch (20) comprises a door latch housing (20A) having an opening positioned in a bottom end thereof, the door latch (20) further comprises a door latch lower housing lip (20ALA) having a door latch lower housing lip opening (20ALAA) therethrough and a door latch upper housing lip (20AUA) having a door latch upper housing lip opening (20AUAA) therethrough, the door latch (20) further comprises a door latch engager (20B) which comprises a door latch engager cylinder (20BA) containing a door latch engager member biasing means (20BCA) positioned against a door latch engager member (20BC), a top distal opening of the door latch engager cylinder (20BA) is slightly smaller in diameter than a diameter of the door latch engager member (20BC), the door latch engager (20B) further comprises a door latch engager plate (20BB) having a door latch engager plate upper opening (20BBU) and a door latch engager plate lower opening (20BBL), the door latch engager member (20BC) frictionally engages a door plate (24A), an upper fastener (22U) is positioned through the door latch engager plate upper opening (20BBU) and the door latch upper housing lip opening (20AUAA) and securely attached to the door side (24S), a lower fastener (22L) is positioned through the door latch engager plate lower opening (20BBL) and the door latch lower housing lip opening (20ALAA) and securely attached to the door side (24S); and a G) a first fastener (18) having a first fastener threaded end (18A), a first fastener tightening cap (18B), and a first fastener shaft (18C), the first fastener (18) is positioned through the door latch housing (20A) opening and through right housing opening (16RB), the first fastener threaded end (18A) engages the left housing threaded opening (16LB).

2. The door knob assembly (10) as described in claim 1, wherein the inner connector (14I) further comprises an inner connector left peg (14IL) and an inner connector right peg (14IR) extending outwardly therefrom, the outer connector (14O) further comprises an outer connector left peg (14OL) and an outer connector right peg (14OR) extending outwardly therefrom.

3. The door knob assembly (10) as described in claim 2, wherein the left housing groove (16LA) comprises a left housing groove outer hole (16LAO) which engages the outer connector left peg (14OL) and a left housing groove inner hole (16LAI) which engages the outer connector left peg (14OL), the right housing groove (16RA) comprises a right housing groove outer hole (16LAO) which engages the outer connector right peg (14OL) and a right housing groove inner hole (16LAI) which engages the outer connector right peg (14OR).

4. The door knob assembly (10) as described in claim 1, wherein the door latch housing (20A) comprises a door latch lower housing (20AL) connected to a door latch upper housing (20AU) by a door latch center housing (20AC) having a door latch center housing opening (20ACA) therethrough.

5. The door knob assembly (10) as described in claim 1, wherein the door latch engager member (20BC) further comprises a door latch engager member spacer (20BCB) positioned within the door latch engager cylinder (20BA) adjacent to an opposite distal end of the door latch engager member biasing means (20BCA) to the door latch engager member (20BC).

6. A door knob assembly (100) attachable to a door (240), the door knob assembly (100) comprising:

A) an inner door knob (120I) having an inner door knob threaded opening (120IA) positioned on an inner door (240I);

B) an outer door knob (120O) having an outer door knob threaded opening (120OA) positioned on outer door (240O);

C) an inner connector (14I) having an inner connector first end (140IA) engagably mounted within the inner door knob threaded opening (120IA), the inner connector (140I) further comprises an inner connector second end (140IB);

D) an outer connector (14O0) having an outer connector first end (140OA) engagably mounted within the outer door knob threaded opening (120OA), the outer connector (140O) further comprises, an outer connector second end (140OB);

E) a housing (160) with a housing threaded opening (160B) therein; and a F) a first fastener (180) having a first fastener threaded end (180A), a first fastener tightening cap (180B), and a first fastener shaft (180C), the first fastener (180) is positioned through the door opening (200A), the first fastener threaded end (180A) engages the housing threaded opening (160B).

* * * * *